US005253460A

United States Patent [19]

Simenoff

[11] Patent Number: 5,253,460

[45] Date of Patent: * Oct. 19, 1993

[54] COLUMN ASSEMBLY

[76] Inventor: George Simenoff, 191 King Street, Weston, Ontario M9N 1L8, Canada

[ * ] Notice: The portion of the term of this patent subsequent to Jun. 23, 2009 has been disclaimed.

[21] Appl. No.: 902,709

[22] Filed: Jun. 22, 1992

Related U.S. Application Data

[63] Continuation-in-part of Ser. No. 642,069, Jan. 16, 1991, Pat. No. 5,123,220.

[51] Int. Cl.[5] ..... E04B 1/00

[52] U.S. Cl. ..... 52/252; 52/259; 52/236.8

[58] Field of Search ..... 52/252, 259, 236.7, 52/236.8, 583, 726

[56] References Cited

U.S. PATENT DOCUMENTS 3,733,757 5/1973 Scott ..... 52/250 X 5,123,220 6/1992 Simenoff ..... 52/252

*Primary Examiner*—Carl D. Friedman

*Assistant Examiner*—Creighton Smith

*Attorney, Agent, or Firm*—Dominik, Stein, Saccocio, Reese, Colitz & Van Der Wall

[57] ABSTRACT

A column assembly having a plurality of floor-height columns which are erected vertically, one on top of the other, to define the floors of the building structure to be constructed. Each column comprises a plurality of reinforcement rods which are embedded in the column and extend outwardly from the ends thereof. The rods are cut at precisely equal lengths to extend precisely equal distances from each end of the column. Each rod is threaded in a precise manner with the thread beginning at the same orientation for each rod such that when the columns are stacked end-to-end, the rods are in perfect axial alignment with the thread of one rod continuously leading into the thread of the contiguous rod to which it is aligned. A threaded sleeve is threaded onto the rods extending from the lower end of the upper column and, after stacking of the upper column end-to-end onto a lower column, the threaded sleeve may be threaded onto the axially aligned and contiguous rods extending from the lower column. A rigid mechanical connection is therefore made between adjacent columns sufficient to support the columns vertically without additional shoring.

12 Claims, 6 Drawing Sheets

COLUMN ASSEMBLY

CROSS-REFERENCE TO RELATED APPLICATIONS

This application is a continuation-in-part application of U.S. patent application, Ser. No. 07/642,069, filed Jan. 16, 1991, to be issued on Jun. 23, 1992 as U.S. Pat. No. 5,123,220.

BACKGROUND OF THE INVENTION

1. Field of the Invention

This invention relates to column assemblies used in the construction of building structures. More particularly, this invention relates to column assemblies having reinforcement rods imbedded within columns and extending from the ends thereof to facilitate connection and alignment of the columns, end to end, during erection.

2. Description of the Background Art

Presently there exists many varieties of construction techniques that employ vertically disposed, floor-height columns which support bearing beams interconnecting adjacent columns, with the bearing beams providing support for the floor above constructed of precast floor slabs, poured-in-place, or the combination of the two.

It is always desirable to erect the column assemblies as precisely vertical as possible while minimizing shoring. In this regard, one technique for minimizing shoring is to extend the reinforcement rods of each column to protrude from their ends and then provide means for aligning the ends via the protruding rods as the columns are stacked vertically one on top of another. In some techniques, the protruding reinforcement rods are aligned by means of an intermediate plate, in others, by slip fitting the rods together. Illustrative examples of such techniques are described in U.S. Pat. No. 976,182, U.S. Pat. No. 1,657,197, U.S. Pat. No. 2,724,261, U.S. Pat. No. 3,613,325, U.S. Pat. No. 3,733,757, U.S. Pat. No. 3,867,805, U.S. Pat. No. 4,081,935, U.S. Pat. No. 4,330,970, U.S. Pat. No. 4,583,336, French Patent 2,387,325 and British Patent 1,045,331.

Of all the above-referenced patents, only U.S. Pat. No. 976,182 employs the use of turnbuckles which threadably engage the aligned ends of the protruding reinforcement rods of columns positioned end to end. Unlike slip-fit sleeves and the other interconnection means shown in the other patents, the turnbuckles taught by U.S. Pat. No. 976,182 provide a means for mechanically interconnecting the rods of adjacent columns stacked one on top of the other. However, the use of turnbuckles for such interconnection requires that the turnbuckles be individually adjusted until the upper column is positioned vertically. Considering the weight of the column, leveling adjustment of the turnbuckles during erection would appear to be difficult since the column would have to remain suspended by a crane as the turnbuckles were threaded onto the rods. Also the total weight of the structure above will have to be carried by the threads of the buckles.

It is an object of this invention to provide an apparatus which overcomes the aforementioned inadequacies of the prior art devices and provides an improvement which is a significant contribution to the advancement of the column assembly art.

Another object of this invention is to provide a column assembly, comprising in combination a first column having a first end and a second end, at least one first threaded rod extending from the second end of said first column, a second column having a first end and a second end, at least one second threaded rod extending from the first end of the second column in axial and contiguous alignment with the first threaded rod defining a space between the second end of said first column and the first end of the second column, and a threaded sleeve threadably interconnecting the first threaded rod and the second threaded rod.

Another object of this invention is to provide a column assembly described hereinabove, wherein a plurality of the first threaded rods extend from the second end of the first column, wherein a corresponding plurality of the second threaded rods extend from the first end of the second column in axial and contiguous alignment with respective first threaded rods, and wherein a corresponding plurality of the threaded sleeves threadably interconnect respective the first threaded rods and the second threaded rods.

Another object of this invention is to provide a column assembly described hereinabove, wherein the first threaded rods extend from the second end of the first column equal distances and wherein the second threaded rods extend from the first end of the second column equal distances.

Another object of this invention is to provide a column assembly described hereinabove, wherein the threaded sleeves comprise a length less than the distance the first threaded rods extend from the second end of the first column or the distance that the second threaded rods extend from the first end of the second column, thereby allowing said threaded sleeves to be threaded fully onto the first threaded rods or the second rods prior to the rods being positioned in axial an contiguous alignment.

Another object of this invention is to provide a column assembly described hereinabove, further comprising grout means filling the space between the second end of the first column and the first end of the second column.

Another object of this invention is to provide a column assembly described hereinabove, wherein the first column further comprises a capital positioned at the second end of the first column, the capital having a surface area greater than the cross-sectional area of the first column defining a ledge for supporting a bearing beam when the columns are positioned vertically.

Another object of this invention is to provide a column assembly described hereinabove, wherein the first column further comprises a plurality of beam anchors cast-in-place at the second end of the first column and corresponding plurality of brackets which removably engage the anchors to protrude from the side of the second end of the first column and provide a support for either precast beams or steel joists.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a column assembly having a plurality of floor-height columns which are erected vertically, one on top of the other, to define the floors of the building structure to be constructed. In one embodiment, the upper end of each column comprises a capital for supporting bearing beams which extend from one column assembly to an adjacent column assembly. In another embodiment, the upper end of each column comprises a plurality of anchors cast-in-place and a corresponding plurality of brackets which removably engage into the anchors and provide support for the bearing beams. The bearing beams provide support for a precast slab floor or a cast-in-place floor.

A primary feature of the invention is the manner in which the columns of each column assembly are interconnected. Specifically, each column comprises a plurality of reinforcement rods which are embedded in the column and extend outwardly from the ends thereof. The rods extend precisely equal distances from each end of the column. Each rod is threaded in a precise manner with the thread beginning at the same orientation for each rod such that when the columns are stacked end-to-end, the rods are in perfect axial alignment with the thread of one rod continuously leading into the thread of the contiguous rod to which it is aligned.

The precise cutting and threading of the rods extending from the ends of the columns allow a threaded sleeve to be threaded onto the rods extending from the lower end of the upper column and, after stacking of the upper column end-to-end onto a lower column, the threaded sleeve may be threaded onto the axially aligned and contiguous rods extending from the lower column. A rigid mechanical connection is therefore made between adjacent columns sufficient to support the columns vertically without additional shoring. Most importantly, the preciseness of the length of the rods assures that a precisely, vertically aligned column assembly is achieved. Leveling adjustment is therefore not necessary or minimized.

Another feature of the column assembly of the invention in one embodiment is the use as a capital at the upper end of a lower column for supporting bearing beams which straddle adjacent column assemblies so as to provide support for the laying of precast floor slabs or, alternatively, to provide support for pouring a cast-in-place floor. In another embodiment, a plurality of anchors are cast-in-place into the upper end of the lower column. A corresponding plurality of brackets removably engage into the anchors to protrude outwardly from the sides of the upper end of the column. The brackets therefore provide support for the precast beams or O.W.S.J, alternatively, to provide support for pouring a cast-in-place floor. The brackets may comprise either a removable U-shaped member having an upstanding end which hooks into a corresponding slot in the anchor or a threaded member which threadably engages into a threaded hole in the anchor.

A still additional feature of the column assembly of the invention is the ability to interconnect the adjacent columns through the bearing beams so as to provide a stronger structure. Likewise, the space created between adjacent columns in a column assembly may be filled with grout or other solidifying material to provide added support and structural connection for the adjacent, interconnect columns. Finally, the cast-in-place floor or the precast floor slabs may be tied to the lower end of the upper column so as to provide more rigid support.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
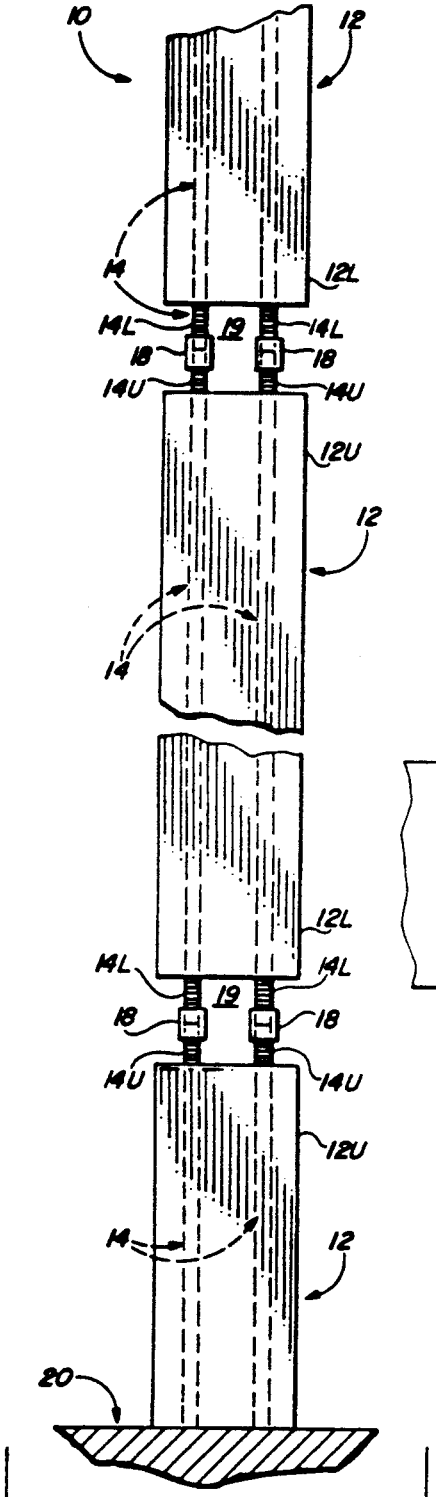
FIG. 1 is a front view of the column assembly of the invention.

Referring to FIG. 1, the column assembly 10 of the invention comprises a plurality of columns 12 each having an upper end 12U and a lower end 12L. A plurality of reinforcement rods 14 (e.g. 4) are imbedded in each column 12 throughout the length thereof and extend from the upper end 12U and the lower end 12L. Each reinforcement rod 14 is of equal length such that their upper ends 14U extend from the upper end 12U of each column 12 by equal distances and such that their lower ends 14L extend from the lower end 12L of the column 12 by equal distances. Both the upper and lower ends 14U and 14L of the reinforcement rods 14 are threaded with the same thread. The beginning of the thread of the upper end 14U of each reinforcement rod 14 of a column 12 is aligned with the beginning of the thread of the lower end 14L of the corresponding reinforcement rod 14 of an adjacent column 12 so that when the respective ends 14U and 14L of the reinforcement rods 14 are positioned in axial and contiguous alignment, the threads of the ends 14U and 14L form a continuous, uninterrupted thread allowing a threaded sleeve 18 to threadably interconnect the upper end 14U of the reinforcement rods 14 extending from the upper end 12U of the column 12 with the lower end 14L of the reinforcement rods 14 extending from the lower end 12L of an upper column 12. In this regard, the length of threaded sleeve 18 is preferably less than the distance that the end 14U or 14L of the reinforcement rods 14 extend from the ends 14U and 14L of the column 12 thereby allowing the threaded sleeve 18 to be threaded onto the end 14U or 14L prior to positioning the respective ends 14U and 14L of the reinforcement rods 14 of the adjacent columns 12 in axial and contiguous alignment.

During assembly, a lowermost floor-height column 12 is positioned vertically and embedded or otherwise rigidly supported by foundation 20. A threaded sleeve 18 is threaded all the way onto the lower end 14L of each reinforcement rod 14 that extends from the lower end 12L of the columns 12 to be erected. A column 12 is hoisted, such as by means of a crane, above the lowermost column 12 and then lowered such that the lower ends 14L of the reinforcement rods 14 extending from the lower end 12L of the column 12 are in axial alignment with and resting on the upper ends 14U of the reinforcement rods 14 extending from the upper end 12U of the lowermost column 12. A space 19 between the upper end 12U of the lowermost column 12 and the lower end 12L of the adjacent column 12 is created. The threaded sleeves 18 are then threaded downwardly so as to secure the axially and contiguously aligned ends 14U and 14L of the reinforcement rods 14, thereby rigidly securing the rods 14 together and forming a mechanically sound connection between the two adjacent columns 12 separated by the space 19. The threaded sleeves 18 may be tack-welded to the rods 14 to preclude any further threaded movement along either ends 14U or 14L of the reinforcement rods 14. As described below, space 19 is to be grouted to provide a more solid support.

Additional floor-height columns 12 may be rigidly connected in series so as to extend the column assembly 12 upwardly to the desired height defining the floors of the structure to be constructed. It should be appreciated that the column assembly 12 as thus constructed comprises a self-supporting, rigid structure that does not require shoring of each added column 12 during assembly.

Figure 2A:
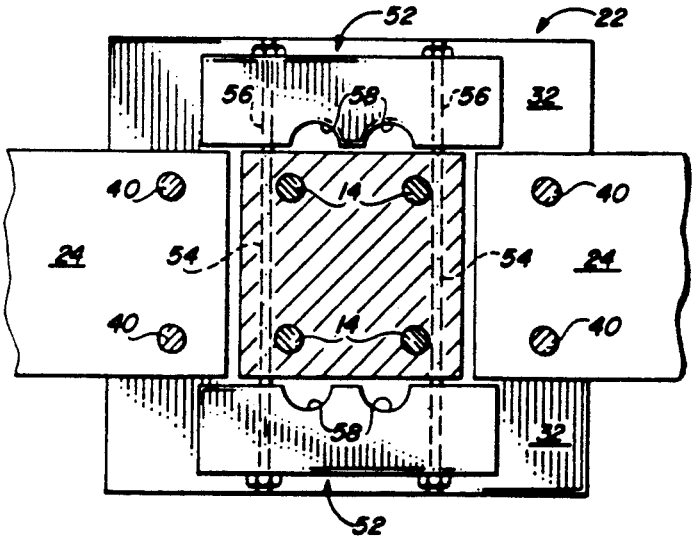
FIG. 2A is a plan view of FIG. 2 taken along lines 2A—2A illustrating the side support precasts.
Figure 3:
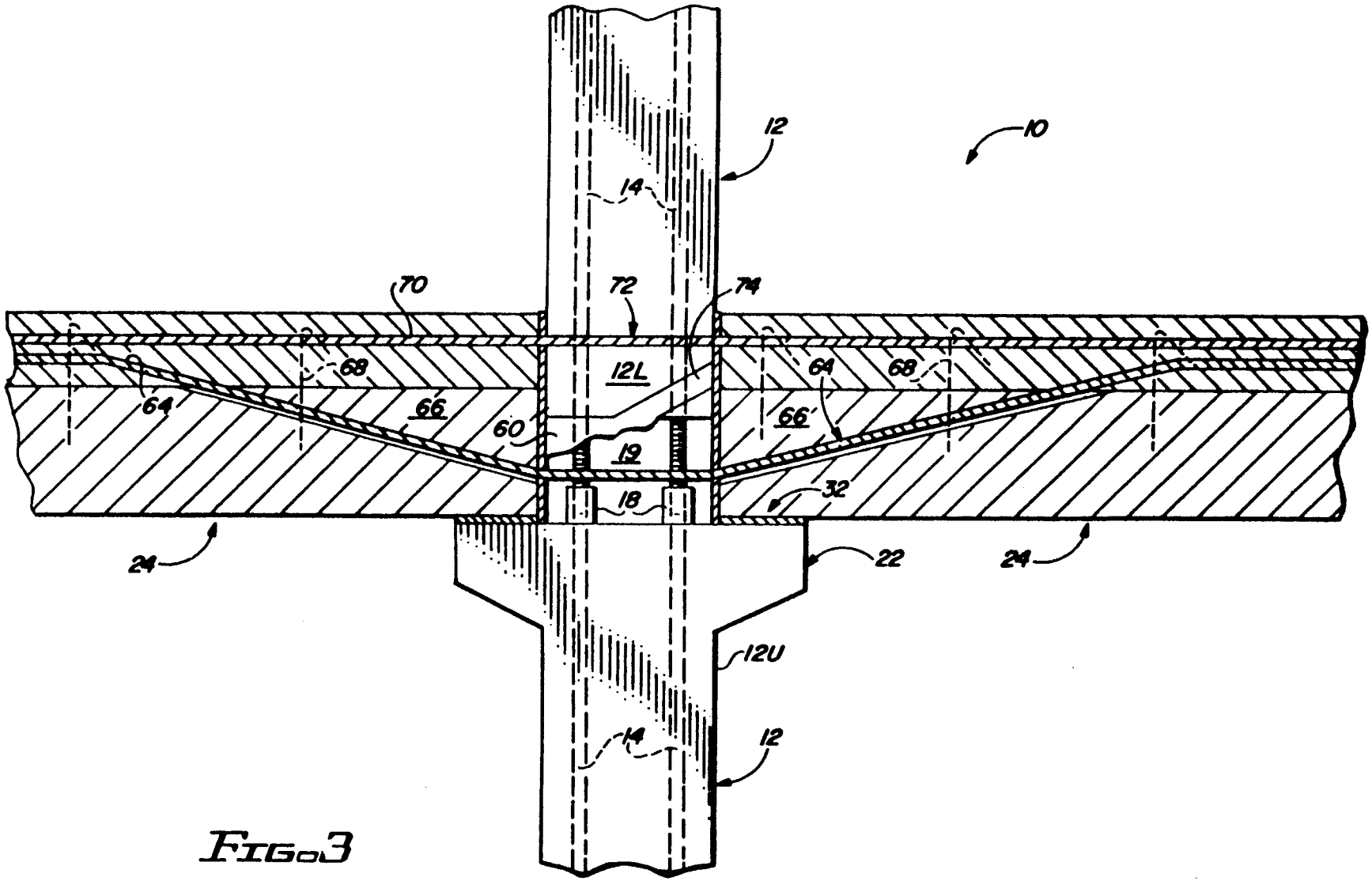
FIG. 3 is a longitudinal cross-sectional view of the column assembly of the invention employing an integral capital on which is seated bearing beams which support a cast-in-place floor.
Figure 2:
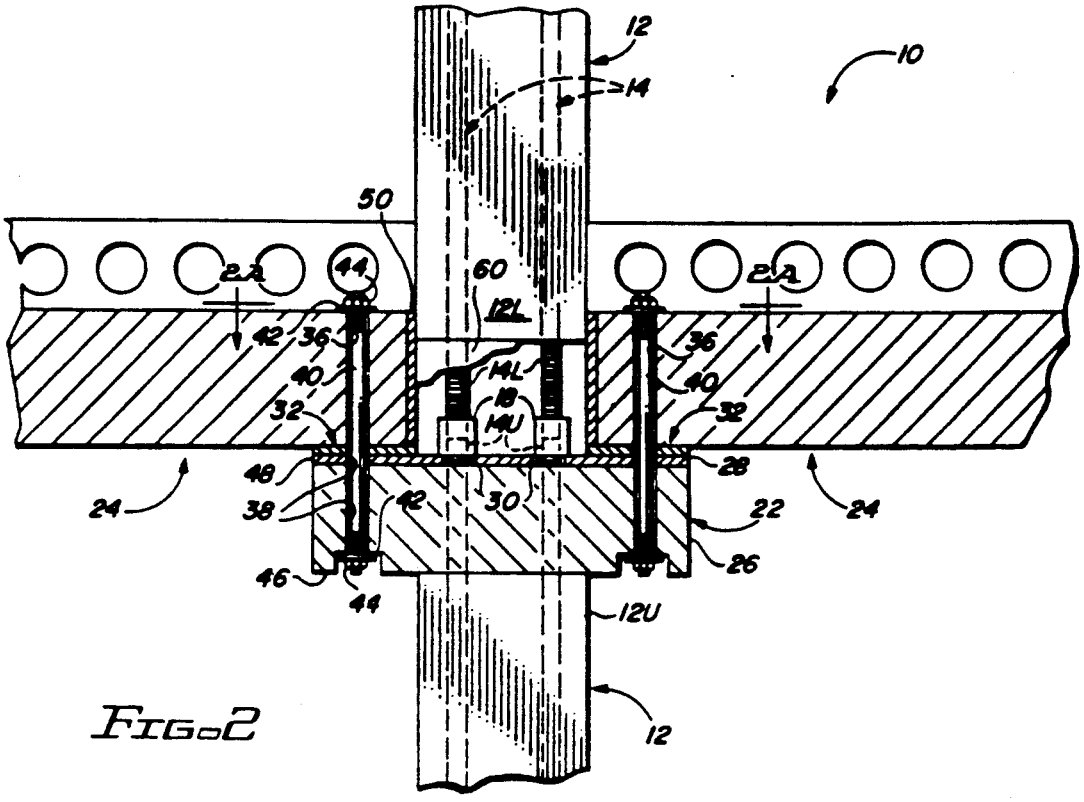
FIG. 2 is a longitudinal cross-sectional view of the column assembly of the invention employing a precast capital on which is seated bearing beams which support a precast slab floor.

As shown in FIGS. 2 and 3, the upper end 12U of each column 12 may be provided with a capital, generally indicated by numeral 22, for supporting bearing beams, generally indicated by numeral 24, which straddle adjacent column assemblies 10 aligned in a row. Additional bearing beams 24 may be provided for straddling adjacent rows of column assemblies 10. The bearing beams 24 provide support for a precast floor slab (see FIG. 2). Alternatively, the bearing beams 24 allow, with appropriate shoring, the pouring of a cast-in-place floor supported by the bearing beams 24 (see FIG. 3).

More particularly, referring to FIG. 2, in one embodiment, capital 22 comprises a precast capital 26 having a metal top plate 28. Apertures 30 are formed through the precast capital 26 so as to allow the upper ends 14U of the reinforcement rods 14 to extend therethrough. The precast capital 26 comprises a surface area greater than the cross-sectional area of the column 12 so as to over-hang the column 12 and define four ledges 32 around the four sides of the column 12 for supporting the bearing beams 24.

During assembly, the lowermost column 12 is positioned vertically as hereinabove described. The precast capital 26 is lowered onto the upper end 12U of the lowermost column 12 so that the upper ends 14U of the reinforcement rods 14 extend through apertures 30 in the precast capital 26. Another column 12 (with threaded sleeves 18 installed) is lowered into place with its lower ends 14L of the reinforcement rods 14 extending from its lower end 12L positioned in axial and contiguous alignment with the upper ends 14U of the reinforcement rods 14 extending through apertures 30 from the upper end 12U of the lowermost column 12. The threaded sleeves 18 are then threaded onto the upper ends 14U of the reinforcement rods 14 so as to rigidly interconnect the columns 12. Notably, the thickness of the precast capital 26 is dimensioned relative to the distance by which the upper ends 14U of the reinforcement rods 14 extend from the upper end 12U of the lowermost column 12 such that the threaded sleeves 18 additionally function to rigidly secure the precast capital 26 to the upper end 12U of the column 12 as the threaded sleeves 18 are threaded onto the upper ends 14U of the reinforcement rods 14.

Without departing from the spirit and scope of this invention, it is noted that the precast capital 26 may comprise simply the metal top plate 28 without precast. In such event, the thickness of the capital 22 would be appreciably less than the distance by which the upper ends 14U of the reinforcement rods 14 extend from the upper end 12U of the column 12. The reinforcement rods 14U should be correspondingly dimensioned shorter to allow the threaded sleeve 18 to rigidly secure the metal top plate 28 to the upper end 12U of column 12.

As shown in FIG. 2, the ends of the bearing beams 24 are seated on the respective ledges 32 of capital 22. Means are provided for rigidly securing the bearing beams 24 to the ledges 32 of the capital 22. More particularly, the edges of the bearing beams 24 are rigidly secured to the ledges 32 of the capital 22 by means of a threaded fastener 34 which extends through hole 36 in the end of each bearing beam 24 and through an aligned hole 38 in ledge 32. As shown, the threaded fastener 34 may comprise a rod 40 threaded at both ends for receiving a washer 42 and nut 44 at both ends. A recess 46 may be formed in the lower surface of the ledge 32 for receiving the washer and nut 42 and 44 at the rod's 40 lower end. It is noted that a neoprene sheet 48 may be positioned between the ends of the bearing beams 24 and the ledges 32. Also, a dense plastic foam spacer 50 may be provided between the end of the bearing beams 24 and the lower end 12L of the upper column 12.

As mentioned earlier, the bearing beams 24 provide support for a precast floor slab (see FIG. 2) or, alternatively, the bearing beams 24 allow, with appropriate shoring, the pouring of a cast-in-place floor supported by the bearing beams 24 (see FIG. 3).

More specifically, the bearing beams 24 are rigidly connected to opposing ledges 32 formed on opposing sides of the upper 12U of each column 12. As shown in FIG. 2A, a side support precast, generally indicated by numeral 52, is positioned on the two other ledges 32 of the capital 22 to function as a form for pouring grout into the space 19 between the upper end 12U of the lower column 12 and the lower end 12L of the upper column 12. The side support precasts 52 are connected to each other by means of threaded fasteners 54 which pass through space 19 and extend horizontally through holes 56 formed in both the side support precasts 52. Upon tightening, fasteners 54 draw the side support precasts 52 together thereby rigidly clamping the side support precasts 52 about the ends of the bearing beams 24.

The side support precast 52 each comprises at least one pour hole 58 positioned on its superior surface allowing grout 60 (see FIG. 2) to be poured into the space 19 after the side support precast 52 are secured into position. Grout 60 functions to provide added support for the column assembly 10.

After the grout 60 is poured, a plurality of precast floor slabs 62 are positioned on the bearing beams 24 as is conventional in the trade for constructing a floor.

As shown in FIG. 3, in another embodiment of the capital 22, the capital 22 is integrally formed at the upper end 12U of the column 12 to define the four ledges 32 for supporting the bearing beams 24. The ends of the bearing beams 24 are rigidly secured together on opposing sides of the upper column 12 by means of an elongated member 64 which passes through space 19 and extends through angled slots 66 formed through the ends of the bearing beams 24. The elongated member 64 preferably comprises a stranded cable which, after passing through space 19 and angled slots 54, extends along the upper surface of the bearing beams 24.

As illustrated, bearing beams 24 are constructed with protruding anchors 68. Once appropriate shoring is erected, a cast-in-place floor can then be poured as is conventional in the trade. During pouring, the stranded cable 64 and the protruding anchors 68 of the bearing beams 24 are imbedded thereby rigidly securing the bearing beams 24 on opposing sides of the columns 12. However, for added strength, another elongated member 70, such as a stranded cable, may be positioned through a horizontal hole 72 in the lower end 12L of the upper column 12 to extend along the upper surface of the bearing beams 24 to also be imbedded during pouring of the cast-in-place floor.

Without departing from the spirit and scope of this invention, the cast-in-place floor as described hereinabove may alternatively be used in lieu of the precast floor slabs 62 described in connection with the precast capital 26. Finally, it is noted that when employing four bearing beams 24 seated on the four ledges 32 of the capital 22 (ninety degrees from each other) of the column 12, the side support precasts 52 are not needed. However, in order to fill the space 19 with grout for added support, a pour hole 74 must be formed angularly within the lower end 12L of the column 12 allowing grout to be poured therethrough to fill the space 19 or grouted by means of a pressure pump.

Figure 4:
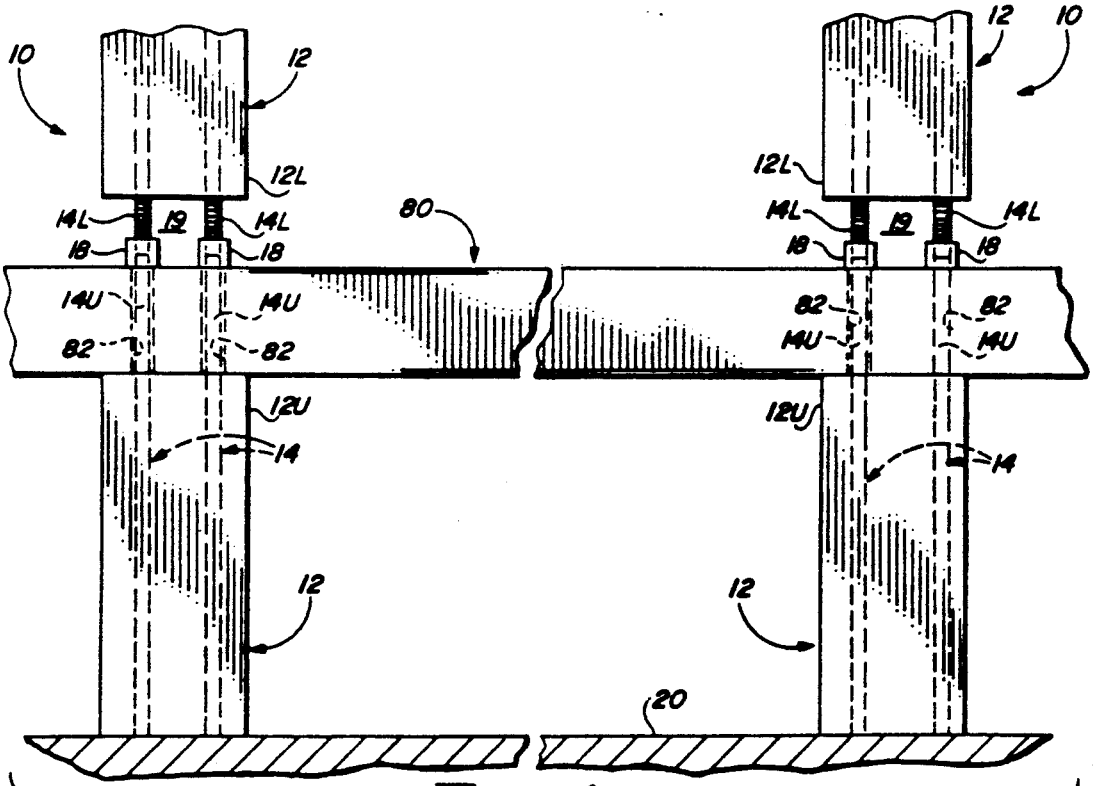
FIG. 4 is a front view of two column assemblies of the invention supporting a bearing beam.

Referring now to FIG. 4, a plurality of column assemblies 10 of the invention may be positioned in a row for supporting a bearing beam 80 having holes 82 positioned transversely therethrough in alignment with the upper ends 14U of the reinforcement rods 14 which extend from the upper end 12U of the columns 12. Holes 82 may be formed over-size to facilitate assembly on top of the upper end 12U of the column 12. After assembly, holes 82 may be grouted. A washer plate (not shown) may then be installed over the ends 14U of the rods 14, to provide a base for the threaded sleeves 18. Similar to the above description in regard to capital 22, the length of the upper ends 14U of the rods 14 ma be dimensioned such that the threaded sleeves 18 can be tightened onto the upper ends 14U so as to rigidly secure the bearing beam 80 to the upper end 12U of the column 12. This embodiment of bearing beams 80 may be used to support the floor above, or can be used in combination with the columns 12 and capitals 22 described hereinabove.

Referring now to FIGS. 5–9, the column assembly 10 of the invention may include a plurality of column anchors 110 which are embedded in the sides of the upper end 12U of each of the columns 12. A corresponding plurality of brackets 112 are provided for removably engaging the column anchors 110. The brackets 112 extend outwardly from the sides of the column to be engaged by corresponding beam anchors 114 of precast bearing beams 24 or steel joists 116. Thus, it should be appreciated that these column and beam anchors 110 and 114 and interconnecting brackets 112 function as a substitute for the capital 22.

Figure 6:
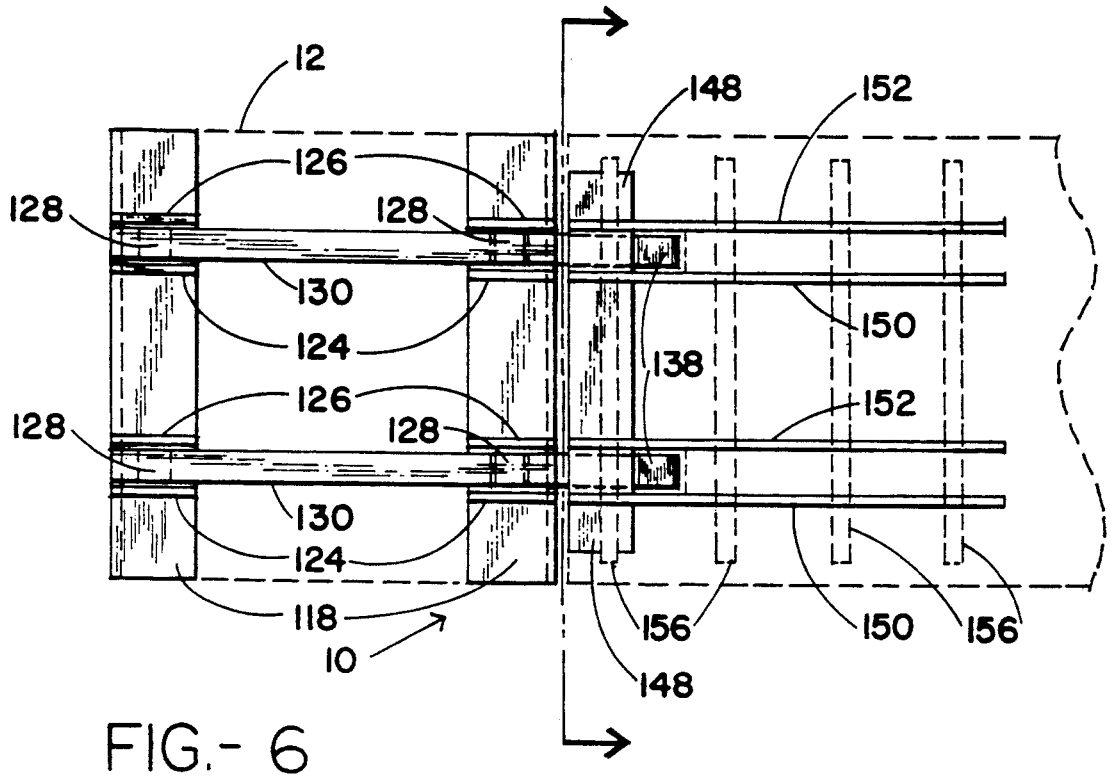
FIG. 6 is a top cross-sectional view of the column assembly of FIG. 5.
Figure 5:
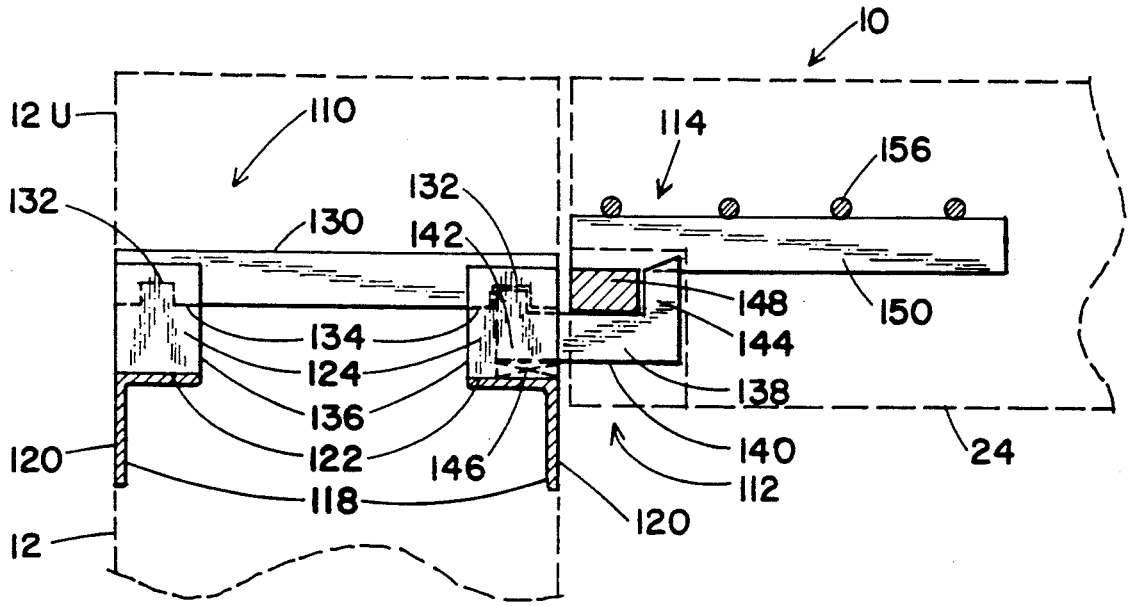
FIG. 5 is a longitudinal cross-sectional view of the column assembly of the invention wherein a plurality of anchors are cast-in-place in the upper end of the column permitting a plurality of U-shaped brackets to removably engage therein to further support a precast bearing beam.
Figure 7:
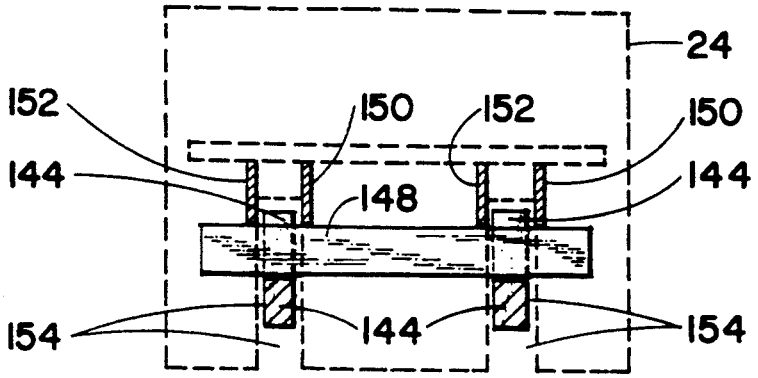
FIG. 7 is a cross-sectional view along lines 7—7 of FIG. 6.

More particularly, in one embodiment as shown in FIGS. 5–7, the column anchors 110 comprise a right angle member 118 having one side 120 positioned flush with the side of the column 12 and its other side 122 positioned horizontally. A pair of steel side members 124 and 126 are positioned in a spaced-apart manner and welded to the horizontal side 122 of the angle member 118 in an upstanding spaced-apart manner thereby providing a space 128 therebetween. A steel bar 130, equal in width to the space 128 between the side members 124 and 126, is positioned in the uppermost area of the side members 124 and 126 and rigidly welded into position. The bar 130 includes a substantially rectangular notch 132 in its lower surface 134. As shown in FIGS. 5 and 6, the bar 130 preferably extends across the width of the column 12 to thereby interconnect the column anchor 110 on one side of the column 12 with the column anchor 110 on the opposing side of the column 12. Also preferably, two column anchors 110 are positioned on each side of the column 12 with the angle member 118 extending across the side width of the column 12 thereby rigidly interconnecting the two column anchors 110. Without departing from the spirit and scope of this invention, it should be appreciated that the column anchors 110 may be positioned on all four sides of the column 12 with the bars 130 rigidly connected to each other and the angle members 118 rigidly connected to each other. As illustrated, the entire assembly of angle members 118, bars 130 and side members 124 and 126, is cast-in-place in the upper end 12U of the column 12 when the column 12 is being cast; however, the space 128 below the notch 132 in the bar 130 and above the horizontal side 122 of the angle member 118 is kept free of concrete during casting so as to define the space 128 bound on its bottom by the horizontal surface 122 of the angle member 118, on its sides by the side members 124 and 126, and at its rear by concrete wall surface 136 (see FIG. 5).

As noted above, a bracket 112 is provided for removable engagement with each of the column anchors 110 embedded within the upper end 12U of the column 12. As shown in FIG. 5, the bracket 112 comprises a double-hook configuration formed in a U-shape 138. More specifically, the U-shaped bracket 138 comprises a horizontal portion 140 and a pair of upstanding end portions 142 and 144 extending from opposing ends of horizontal portion 140. The thickness of the U-shaped bracket 138 is appreciably less than the distance between the side members 124 and 126 of the column anchor 110 so that the end portion 142 may slidably fit within the space 128 between the side members 124 and 126. The tip of the upstanding end portion 142 is preferably squared off and dimensioned to easily fit into the notch 132 in the bar 130. During assembly, the bracket 138 may be canted relative to the column anchor 110 and its upstanding end portion 142 inserted into the space 128 between the side members 124 and 126 and then pivoted upwardly so that its tip firmly seats or "hooks" into the notch 132 in the bar 130. A space 146 is provided for positioning between the underside of the U-shaped bracket 138 and the horizontal surface 122 of the angle member 118 so as to keep the tip of the upstanding end member 142 in engagement of the notch 132 of the bar 130. Once installed in this manner, the other upstanding end portion 144 of the U-shaped bracket 138 protrudes outwardly and upwardly from the side of the column 12 so as to "hook" the beam anchor 114 cast-in-place in a precast bearing beam 24.

The beam anchor 114 comprises a transversely positioned bar 148 having a width appreciably less than the distance by which the U-shaped bracket 112 extends from the side of the column 12. A pair of longitudinal side members 150 and 152 are rigidly welded to bar 148 in a spaced-apart manner to define a space 154 for receiving the upstanding end portion 144 of the bracket 112 therebetween (see FIG. 7). As best shown in FIG. 6, two beam anchors 114 may be cast-in-place in the end of the beam 24 and the bar 148 may extend across the width of the bearing beam 24 so as to connect one beam anchor 114 with the other. Similarly, each of the paired side members 150 and 152 may be rigidly interconnected by means of transversely extending reinforcement rods 156 or the like. The entire assembly is cast-in-place within the end of the bearing beam 24; however, the space 154 below the bar 148 and the side members 150 and 152 is kept free of concrete so as to provide room for the upstanding end portion 144 of the U-shaped bracket 112 to be inserted therein and "hook" under the bar 148.

During assembly, the columns 12 are erected in the manner described hereinabove. The brackets are installed into the column anchors 110 of each of the columns. The beams 24 are then lowered into position so that the brackets 112 hook onto the bar 148 embedded within the beam 24. In this regard, it is noted that the casting of the column anchors 110 in the column 12 and the casting of the beam anchors 114 in the beam 24 may be such that, when assembled, the top of the column 12 is flush with the top of the beam 24 so as to provide a flat surface permitting a floor to be poured into place.

Figure 9:
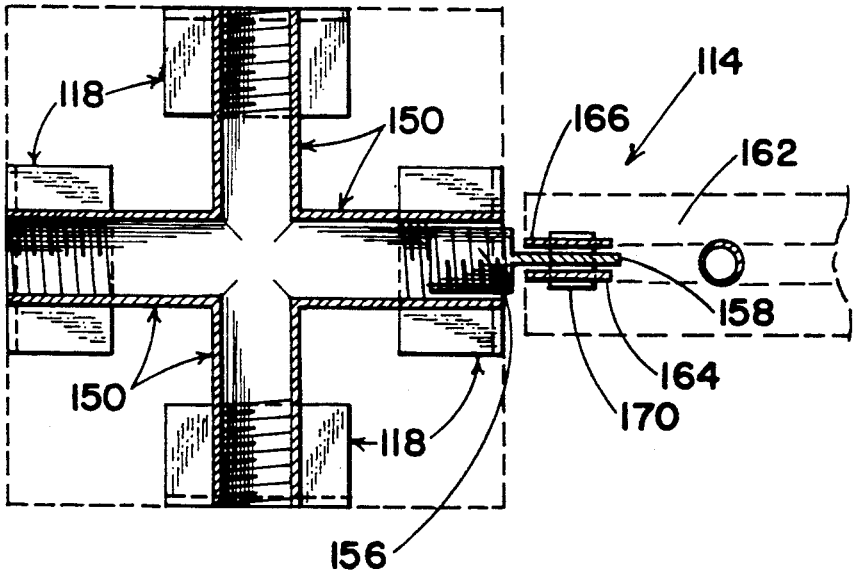
FIG. 9 is a top cross-sectional view of FIG. 8.
Figure 8:
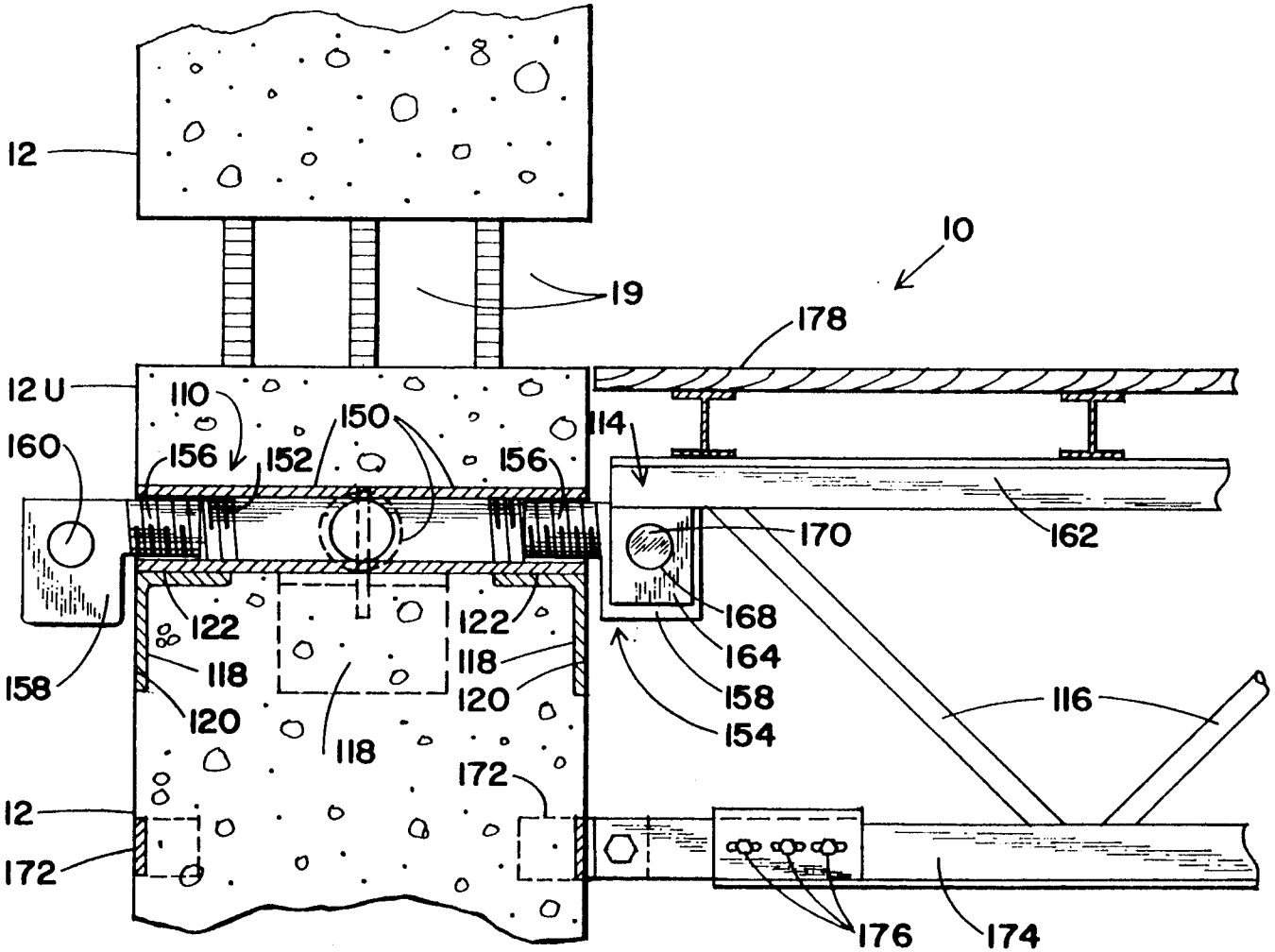
FIG. 8 is a longitudinal cross-sectional view of the column assembly of the invention employing a plurality of anchors cast-in-place in the upper end of the column for threadably receiving a plurality of threaded brackets to provide support for a steel joist bearing beam.

Referring now to FIGS. 8 and 9, in another embodiment, a column anchor 110 is provided which comprises a generally hollow cylindrical member 150 having internal thread 152 which is rigidly welded to angle member 118. The column anchors 110 may be positioned, as shown, one on each of the four sides of the column 12. All of the column anchors 110 are cast-in-place within the upper end 12U of the column 12.

A threaded bracket 154 is provided having a threaded boss 156 for threadably engaging into the thread 152 of the cylindrical member 150 and having a flat portion 158 extending from the sides of the column 12. A hole or slot 160 is provided in the flat portion 158.

A beam anchor 114 is rigidly welded to the end of a steel truss 162. The beam anchor 114 comprises paired side members 164 and 166 with aligned holes 168. A removable bearing pin 170 is provided for removably engaging through the holes 168 in the opposing side members 164 and 166 of the beam anchor 114 and the hole 160 in the flat portion 158 of the bracket 154.

During assembly, the steel joists 116, having the beam anchors 114 welded to the ends thereof, are positioned between opposing columns 12 and aligned in such a manner that the flat portion 158 of the bracket 154 engages between the side members 164 and 166 of the beam anchor 114. The bearing pin 170 is then inserted through the holes 168 and 160 so as to rigidly secure the steel joist 116 to the column 112. It is noted that a bearing plate 172 may be cast-in-place in the column 12 in alignment with the bottom member 174 of the steel truss 116 to provide additional support for the truss 116. It is also noted that this bottom member 174 may be made slightly telescopic via adjustment screws 176 so that it bears directly against the bearing plate 172.

Once the steel joist 116 is connected to the columns 12 via the brackets 154, a plywood floor 178 may be laid on top of the joists 116 level with the top of the column 12. A concrete floor may then be poured into place on top of the floor 178 and in the space 19 formed between the ends of the columns 12.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A column assembly, comprising in combination:

a first column having a first end and a second end;

at least one first threaded rod extending from said second end of said first column;

a second column having a first end and a second end;

at least one second threaded rod extending from said first end of said second column in axial and contiguous alignment with said first threaded rod defining a space between said second end of said first column and said first end of said second column;

a threaded sleeve threadably interconnecting said first threaded rod and said second threaded rod;

a column anchor positioned in a side of said first column adjacent to said second end of said first column;

beam means.

a beam anchor connected relative to said beam means; and a bracket for interconnecting said column anchor and said beam anchor.

2. The column assembly as set forth in claim 1, wherein a plurality of said first threaded rods extend from said second end of said first column, wherein a corresponding plurality of said second threaded rods extend from said first end of said second column in axial and contiguous alignment with respective said first threaded rods, and wherein a corresponding plurality of said threaded sleeves threadably interconnect respective said first threaded rods and said second threaded rods.

3. The column assembly as set forth in claim 2, wherein said first threaded rods extend from said second end of said first column equal distances and wherein said second threaded rods extend from said first end of said second column equal distances.

4. The column assembly as set forth in claim 3, wherein said threaded sleeves comprise a length less than said distance said first threaded rods extend from said second end of said first column or said distance that said second threaded rods extend from said first end of said second column, thereby allowing said threaded sleeves to be threaded fully onto said first threaded rods or said second rods prior to said rods being positioned in axial and contiguous alignment.

5. The column assembly as set forth in claim 4, further comprising grout means filling said space between said second end of said first column and said first end of said second column.

6. The column assembly as set forth in claim 4, wherein a plurality of column assemblies are positioned in a row with said beam means interconnecting adjacent said column assemblies and wherein a plurality of said rows of interconnected column assemblies are positioned so as to define an elevated floor support.

7. The column assembly as set forth in claim 1, wherein said beam means comprises a precast beam and wherein said beam anchor is cast-in-place with said precast beam.

8. The column assembly as set forth in claim 7, wherein said column anchor comprises a pair of side members and a bar which define a space and wherein said bracket includes an upstanding end which removably engages said bar.

9. The column assembly as set forth in claim 8, wherein said beam anchor comprises said column anchor comprises a pair of side members and a bar which define a space and wherein said bracket includes another upstanding end which removably engages said bar in said precast beam.

10. The column assembly as set forth in claim 1, wherein said beam means comprises a truss beam and wherein said beam anchor is rigidly connected to said truss beam.

11. The column assembly as set forth in claim 10, wherein said column anchor comprises a threaded member including a thread and wherein said bracket includes a threaded end which threadably engages said thread of said column anchor.

12. The column assembly as set forth in claim 11, wherein said beam anchor comprises a pair of side members and a bar which define a space and wherein said bracket includes another end which removably engages said bar in said truss beam.

* * * * *